US006822377B1

(12) United States Patent
Venn et al.

(10) Patent No.: US 6,822,377 B1
(45) Date of Patent: Nov. 23, 2004

(54) IGNITION DEVICE AND METHOD FOR PRODUCING IT

(75) Inventors: Carsten Venn, Bamberg (DE); Klaus Hrastnik, Stuttgart (DE); Thomas Jaeger, Erdmannhausen (DE); Hellmut Schmid, Sachsenheim (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/069,265

(22) PCT Filed: Aug. 23, 2000

(86) PCT No.: PCT/DE00/02880

§ 371 (c)(1),
(2), (4) Date: Jun. 4, 2002

(87) PCT Pub. No.: WO01/15293

PCT Pub. Date: Mar. 1, 2001

(30) Foreign Application Priority Data

Aug. 25, 1999 (DE) ..... 199 40 455

(51) Int. Cl.[7] ..... F02M 57/06
(52) U.S. Cl. ..... 313/118; 313/11.5; 313/143
(58) Field of Search ..... 313/11.5, 118, 313/130, 131 R, 131 A, 137, 143

(56) References Cited

U.S. PATENT DOCUMENTS 4,297,405 A * 10/1981 Kasahara et al. ..... 428/141
4,489,596 A * 12/1984 Linder et al. ..... 73/116
4,967,116 A 10/1990 Oshima ..... 313/141
5,550,424 A * 8/1996 Jennrich et al. ..... 313/130

FOREIGN PATENT DOCUMENTS

| | | |
|---|---|---|
| DE | 38 41 215 A1 | 6/1989 |
| GB | 1 051 392 A | 12/1966 |
| GB | 2 054 738 A | 2/1981 |
| GB | 2 078 261 A | 1/1982 |

OTHER PUBLICATIONS

Database WPI Section PQ, Week 199622 Derwent Publication Ltd., London, GB, ClassQ52, An 1996–220521 XP002154620 & RU 2 044 152 C, Sep. 20, 1995.

Patent Abstracts of Japan vol. 015, No. 277 (E–1089),Jul. 15, 1991 & JP 03 095885 A, Apr. 22, 1991.

Patent Abstracts of Japan, vol. 017, No. 698 (E–1481) Dec. 20, 1993 & JP 05 242954 A, Sep. 21, 1993.

Patent Abstracts of Japan vol. 013, No. 190 (C–593), May 8, 1989 & JP 01 015397 A, Jan. 19, 1989.

* cited by examiner

*Primary Examiner*—Haissa Philogene
(74) *Attorney, Agent, or Firm*—Michael J. Striker

(57) ABSTRACT

An ignition device, in particular, a spark plug for Otto engines, includes an electric connection (11) and a tubular metal housing (13) with a screw-in thread (18) stamped on it. At least one of the metal components of the spark plug is provided with a paint coating that serves to protect the spark plug from corrosion.

10 Claims, 2 Drawing Sheets

IGNITION DEVICE AND METHOD FOR PRODUCING IT

BACKGROUND OF THE INVENTION

The invention relates to an ignition device and to a method for producing it.

Spark plugs essentially comprise a metal housing and an insert, which includes a ceramic insulator, a connection bolt, and a middle electrode. The steel materials used for the housing, for reasons of function, production and cost, corrode above all from the hot, corrosive atmosphere of the kind that occurs during operation in a vehicle. To protect against corrosion, the steel housing is typically coated with a metal layer.

As the metallizing layer, zinc or nickel is used, for instance. The anti-corrosion action of the zinc is based on the fact that as a less-noble metal, it corrodes instead of the iron and forms so-called white rust. This cathodic protection effectively prevents the iron from corroding. The formation of white rust is undesirable, however, from an aesthetic standpoint.

Nickel, which is a more-noble metal than iron electrochemically, can also be used to create an anti-corrosion layer. A problem then is that mechanical injuries to the protective layer lead to corrosion of the exposed iron and hence lead to the formation of so-called red rust. In German Patent DE-PS 38 41 215 C2, it is proposed that to prevent rust formation a chromate layer be applied to the nickel protective layer; the chromate layer covers the cracks and pores in the protective layer. Chromate treatment involves major environmental risks, however.

SUMMARY OF THE INVENTION

The ignition device of the invention has the advantage that the paint layer brings about effective corrosion protection that is durable even at elevated temperatures and is simple to achieve. For instance, a spark plug that has been provided with a paint coating according to the invention exhibits no evidence of corrosion whatever even after a 100-hour salt-spray test.

With the provisions recited in the dependent claims, advantageous refinements of the ignition device according to the invention and the method according to the invention are possible.

For instance, the painting of the ignition device can be combined with other methods for corrosion protection, such as nickel-plating or zinc-plating. Furthermore, many painting methods are available that make it possible to adapt the painting process to the assembly of the ignition device. The painting of the individual components is preferably done after they have been mounted on the finished ignition device.

It can be considered especially advantageous that with the aid of a paint coating, beyond the corrosion protection not only can the visual appearance of the ignition device be improved but the sliding property, for instance, of a thread stamped onto the hous ing is also favorable affected.

BRIEF DESCRIPTION OF THE DRAWINGS

One embodiment of the invention is shown in the drawing, taking a spark plug as an example, and described in further detail in the ensuing description.

DESCRIPTION OF THE PREFERRED EMBODIMENT

Figure 1:
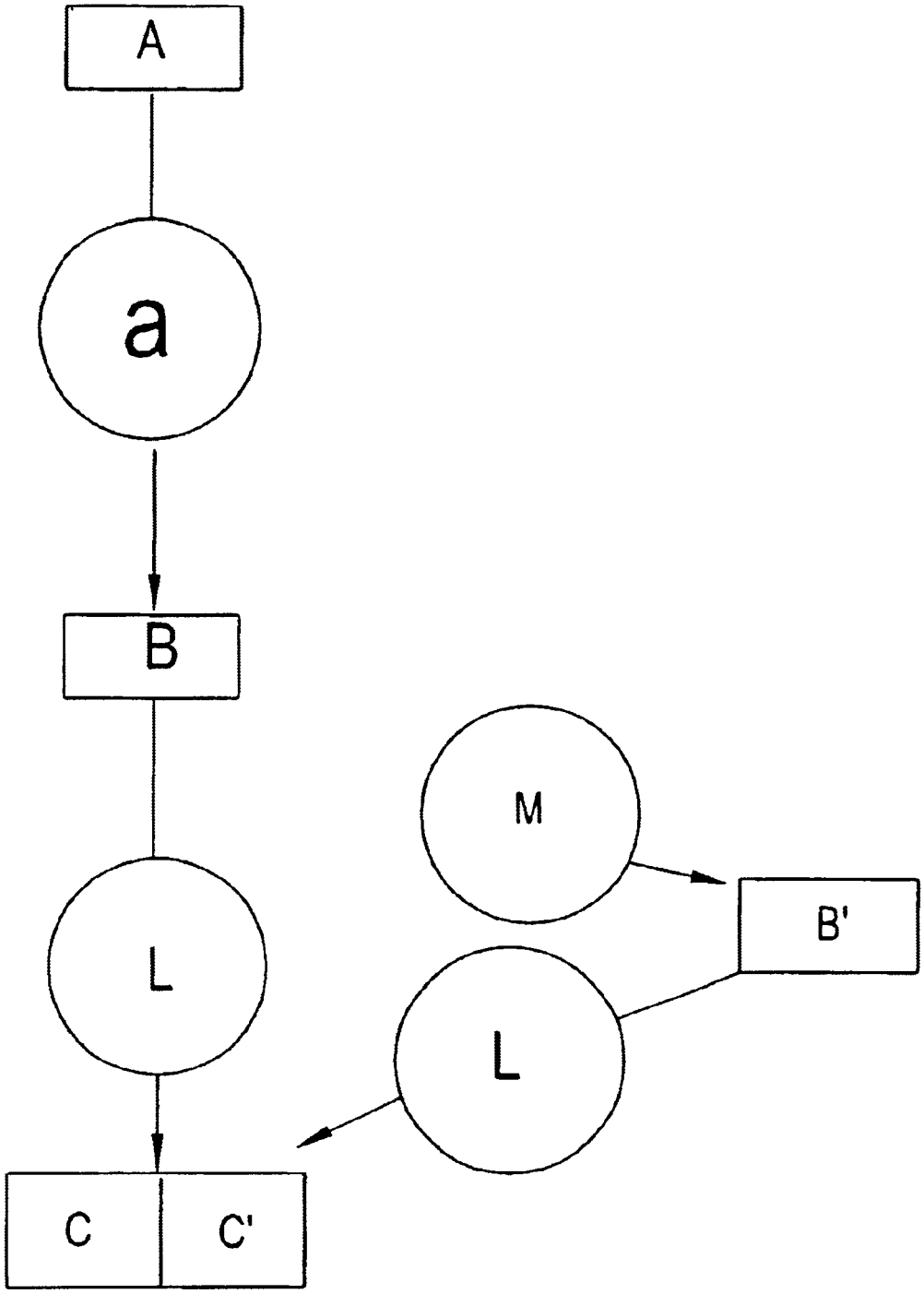
FIG. 1 is a sectional view through one exemplary embodiment of this spark plug.

The spark plug of the present invention includes a tubular metal housing 13, in which a ceramic insulator 24 is disposed. The insulator 24, on its end 27 toward the combustion chamber, encases a middle electrode 22 and insulates it electrically from the housing 13. It also includes a contact pin 20, which serves to transmit the voltage to the middle electrode 22, and on its connection end 28 it has a connection means 11. The connection means 11 assures the electrical contacting of the middle electrode 22 to an external voltage supply, not shown. It essentially includes a connection bolt 12, which additionally, on its connection end, is provided with a thread and a connection nut 19. Between the connection means 11 and the contact pin 20 is a spark extinguishing resistor 25, which comprises an electrically conductive glass and not only provides mechanical anchoring for the spark plug components disposed in the insulator 24 but also represents a gas-tight closure from the combustion pressure. Between the insulator 24 and the housing 13 is an inner sealing seat 17, which seals off the interior of the spark plug 10 from the combustion chamber.

Up to four ground electrodes 21 are welded to the housing 13. The ignition spark is generated between these electrodes and the middle electrode 22. The electrodes 21, 22 comprise a multi-substance alloy based on nickel and for instance contain a copper core. However, it is also possible to use silver, platinum, or platinum alloys as electrode materials.

The housing 13 has a hexagon 14 on its outside that makes it possible to screw the spark plug into an engine block. An outer sealing seat 16 is also provided, which seals off the ambient atmosphere from the combustion chamber. The screw-in thread 18 stamped on the housing 13 serves to anchor the spark plug in the engine block.

Next to the hexagon 14, the housing 13 contains a shrinkage notch 15. During the production process of the spark plug, the housing 13 is briefly subjected to a high voltage. As a result, the shrinkage notch heats to temperatures of approximately 1200° C. At the same time, a high mechanical pressure is exerted on the housing 13 along the longitudinal axis of the spark plug, and under its effect the shrinkage notch 15 deforms. This operation is called hot pressing and serves to seal off the spark plug.

According to the invention, the corrosion protection of the metal components of the spark plug is brought about by applying a paint coating to the components that form the outer face of the spark plug. Paints that can be given primary consideration are heat-stable, moisture-proof and solvent-proof paints, which preferably harden under UV light to make fast curing of the paint possible. The paints are preferably colorless, or they can be provided with colored pigments.

For the painting l of the spark plug B to produce a painted spark plug C (see FIG. 2), various painting processes can be considered. An example of an especially preferred method is a spray method in which the regions of the spark plug that are not to be painted are covered with a template, and the spark plug is rotated about its longitudinal axis during the process. Along with this method, known as templating, a combined spray and suction method, the so-called called vacuumate technique, can be employed as an alternative. In it, the paint is sprayed in an aimed stream at the spark plug to be painted, and at the same time it is made highly turbulent by suction devices disposed next to the spray nozzle, and excess paint is immediately vacuumed away. Another especially suitable method that can be used is an ink-jet technique, in which an aimed stream of fine droplets is sprayed on in such a way that the droplets strike the surface close together.

The painting l of the spark plug is especially advantageously done, from a production standpoint, after the complete assembly a of the spark plug B from the components A. This makes it unnecessary to integrate painting units into production lines and furthermore makes it optionally possible to paint only those spark plugs that are intended for especially long service lives (long-life type), for instance. If the spark plug is produced by a hot pressing method, then painting prior to the assembly a would already be disadvantageous because as a result of the high temperatures occurring in the hot pressing, the paint layer would be damaged in the region of the shrinkage notch 15. If the spark plug is alternatively sealed off by a cold pressing method, then the components can also be painted individually before the assembly a of the spark plug B. In that case, the painting can also be done by means of immersion baths.

Figure 2:
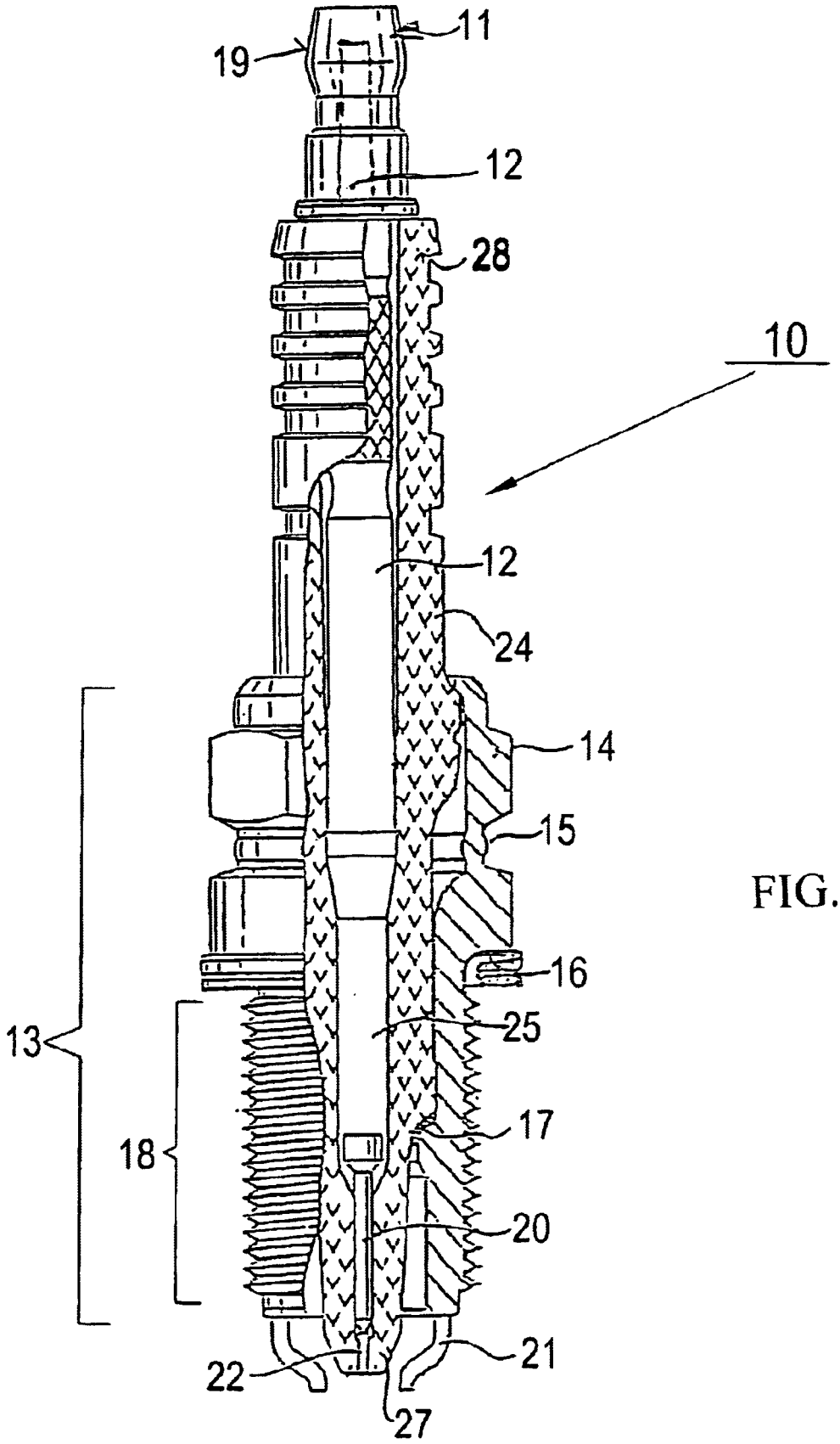
FIG. 2 is a schematic illustration of the method for producing it according to the invention.

Depending on the requirements, it is possible to use a combination of metallizing m and painting l as corrosion protection. Then, as shown in FIG. 2, the assembled spark plug B is first metallized m, and the metallized spark plug B' is then painted l, resulting in the metallized, painted spark plug C'. Direct painting l of the non-metallized spark plug B to make the spark plug C is also possible. The combination of metallizing m and painting l especially advantageously achieves better protection against mechanical damage to the anti-corrosion layer, since two protective layers are applied one above the other; converse ly, omitting the metallizing m leads to improved adhesion of the painting l to the components to be protected against corrosion.

By the method according to the invention, all the components of the spark plug that are affected by corrosion can in principle be protected, if they are not exposed to a temperature of substantially more than 400° C. This applies especially to the housing 13, which is painted either including or not including the thread 18. Care must be taken that the paint used have sufficient friction resistance to the mechanical forces that engage the hexagon 14. Depending on requirements, painting of the connection means 11 is done in addition. This applies above all to the connection bolt 12 and the connection nut 19.

Painting the thread 18 can be considered especially advantageous, because here not only can the corrosion protection to the component be assured but moreover influence is exerted on the sliding properties of the component. This is an important aspect above all in spark plugs with a long service life, since after a long time in operation they can often be removed from the engine block again only with great difficulty.

The creation of corrosion protection by means of painting is not limited to spark plugs. For instance, glow plugs used in Diesel engines as an aid in starting, for instance, are similar in their design and can be equally effectively protected against corrosion with the aid of a paint coating.

What is claimed is:

1. An ignition device formed as a spark plug for Otto engines or as a glow plug for Diesel engines, comprising electrical connection means; a tubular housing with a screwed-in thread stamped onto it, at least one metal component of the ignition device being at least in part provided on an outside with anti-corrosion means in a form of a paint.

2. An ignition device formed as a spark plug for Otto engines or as a glow plug for Diesel engines, comprising electrical connection means; a tubular metal housing with a screwed-in thread stamped onto it, at least one metal component on an outside of the ignition device being at least in part provided with anti-corrosion means in a form of a paint, wherein at least one of said electrical connection means, said housing, and said screw-in thread has a metallizing layer.

3. The ignition device as defined in claim 2, wherein at least one of said electrical connection means, said housing and said screw in thread is provided with a paint.

4. The ignition device as defined in claim 2, wherein the paint is applied over said metalizing layer.

5. The ignition device as defined in claim 2, wherein said metalizing layer contains zinc.

6. The ignition device as defined in claim 2, wherein said metalizing layer contains nickel.

7. The ignition device as defined in claim 2, wherein said paint is colorless.

8. A method of producing an ignition device formed as a spark plug for Otto engines having electrical connection means, a tubular metal housing, a screwing thread stamped onto the tubular metal housing, the method comprising the steps of providing on at least one metal component at least partially anti-corrosion means in a form of a paint and subjecting the spark plug to a metalizing process prior to application of the paint.

9. The method as defined in claim 8, further comprising the step of applying the paint by spraying using a device selected from the group consisting of a template and a suction device.

10. The method as defined in claim 8, further comprising the step of painting at least one of the connection means, the housing, and the screw-in thread after assembly of the spark plug.

* * * * *